US007610734B2

(12) United States Patent
Edwards et al.

(10) Patent No.: US 7,610,734 B2
(45) Date of Patent: Nov. 3, 2009

(54) SIDING INSTALLATION APPARATUSES AND METHODS FOR INSTALLING SIDING PIECES ON WALLS

(75) Inventors: Jonathan Edwards, Bremerton, WA (US); Scott Fladgard, Kingston, WA (US); Joseph Gaidjiergis, Renton, WA (US); Randy L. Jennings, Raymond, WA (US)

(73) Assignee: Shear Tech, Inc., Kingston, WA (US)

( * ) Notice: Subject to any disclaimer, the term of this patent is extended or adjusted under 35 U.S.C. 154(b) by 21 days.

(21) Appl. No.: 11/595,617

(22) Filed: Nov. 8, 2006

(65) Prior Publication Data

US 2007/0193207 A1 Aug. 23, 2007

Related U.S. Application Data

(62) Division of application No. 10/607,643, filed on Jun. 26, 2003, now Pat. No. 7,134,253.

(60) Provisional application No. 60/474,685, filed on May 30, 2003.

(51) Int. Cl.
*E04B 1/00* (2006.01)
*E04G 21/00* (2006.01)
*E04F 21/14* (2006.01)

(52) U.S. Cl. ..... 52/749.11; 52/749.1; 52/DIG. 1; 52/747.11; 33/647

(58) Field of Classification Search ..... 52/749.1, 52/749.11, 749.12, 749.13, DIG. 1, 747.11; 296/217, 904; 33/646–649
See application file for complete search history.

(56) References Cited

U.S. PATENT DOCUMENTS

| | | | | | |
|---|---|---|---|---|---|
| 390,459 | A | * | 10/1888 | Davis | 33/646 |
| 1,031,854 | A | | 7/1912 | Keyes | |
| 2,891,318 | A | * | 6/1959 | Harrison et al. | 33/648 |
| 3,357,464 | A | | 12/1967 | Vroman | |
| 3,792,852 | A | * | 2/1974 | Reniker | 269/95 |
| 4,155,175 | A | | 5/1979 | Stiles | |
| 4,425,714 | A | | 1/1984 | Kelly, Jr. | |
| 4,658,490 | A | | 4/1987 | Czelusniak et al. | |
| 4,698,942 | A | | 10/1987 | Swartz | |
| 4,819,404 | A | | 4/1989 | Lafayette, Jr. | |
| 4,862,669 | A | | 9/1989 | Jacobsen | |
| 5,290,019 | A | | 3/1994 | Beyers | |
| 5,291,719 | A | | 3/1994 | Buster | |
| 5,319,909 | A | | 6/1994 | Singleterry | |
| 5,456,053 | A | | 10/1995 | Fischer | |
| 5,465,499 | A | | 11/1995 | LaPlante | |
| 5,623,767 | A | | 4/1997 | Colavito | |
| 5,692,311 | A | * | 12/1997 | Paquin | 33/647 |
| 6,223,492 | B1 | | 5/2001 | Barnhart et al. | |

(Continued)

*Primary Examiner*—Richard E Chilcot, Jr.
*Assistant Examiner*—Elizabeth A Plummer
(74) *Attorney, Agent, or Firm*—Perkins Coie LLP

(57) ABSTRACT

Siding installation apparatuses and methods for engaging a first siding piece and supporting a second siding piece are disclosed herein. In one embodiment, the apparatus includes a support member having a support surface to support the second siding piece, an engagement member projecting from the support member, and a securing assembly coupled to the support member to releasably restrict the support member from moving relative to the first siding piece. The engagement member is configured to engage the bottom portion of the first siding piece by contacting the back surface.

13 Claims, 3 Drawing Sheets

U.S. PATENT DOCUMENTS

| | | | | |
|---|---|---|---|---|
| 6,367,160 | B1 | 4/2002 | Rempe | |
| 6,370,836 | B1 | 4/2002 | Gunn | |
| 6,434,909 | B1 | 8/2002 | Carpenter | |
| 6,438,924 | B1 | 8/2002 | Clover | |
| 6,494,016 | B1 | 12/2002 | Bankson | |
| 6,612,089 | B1 | 9/2003 | Mann | |
| 6,755,022 | B2 | 6/2004 | Pendrous et al. | |
| 6,814,334 | B1 | 11/2004 | Whitehead | |
| 6,836,969 | B1 * | 1/2005 | Bates | 33/42 |
| 6,871,846 | B2 * | 3/2005 | Antill | 269/21 |
| 6,928,743 | B1 | 8/2005 | Marshall | |
| 2002/0023366 | A1 | 2/2002 | Bueno | |
| 2003/0014877 | A1 * | 1/2003 | Nadal et al. | 33/647 |

* cited by examiner

SIDING INSTALLATION APPARATUSES AND METHODS FOR INSTALLING SIDING PIECES ON WALLS

CROSS-REFERENCE TO RELATED APPLICATION

This application claims the benefit of U.S. Provisional Patent Application No. 60/474,685 entitled SIDING INSTALLATION APPARATUSES AND METHODS FOR INSTALLING SIDING PIECES ON WALLS filed on May 30, 2003, which is hereby incorporated by reference in its entirety.

TECHNICAL FIELD

The present invention generally relates to siding installation apparatuses and methods for installing siding pieces on walls of houses and other structures. More particularly, the invention is directed toward siding installation apparatuses that engage a first siding piece which is attached to a wall and support a second siding piece for attachment to the wall.

BACKGROUND

The exterior surfaces of houses and other structures are often protected by exterior siding products made from wood, vinyl, aluminum, bricks, stucco, fiber-cement, and other materials. Wood and fiber-cement siding products, for example, include panels, planks, and shakes that are "hung" on plywood or composite walls. Although wood siding products are popular, wood siding has several drawbacks. For example, wood siding can become unsightly or even defective due to rotting, warping, or cracking. Wood siding products are also highly flammable and subject to insect damage.

Fiber-cement siding products offer several advantages over other types of siding materials. Fiber-cement siding is a composite material composed of cement, silica sand, cellulose, and binders. To form fiber-cement siding pieces, a liquid fiber-cement composite is rolled or pressed into the shape of the piece and then cured. Fiber-cement siding is advantageous because it is nonflammable, weatherproof, and relatively inexpensive to manufacture. Moreover, fiber-cement siding does not rot, warp, or crack.

One concern with fiber-cement siding pieces is that they are difficult for one person to install because the siding pieces are typically twelve feet long and heavy. Accordingly, installation generally requires one person to hold one end of a piece while another person holds and nails the other end of the piece. To address this concern, tools have been developed to support a siding piece during installation. These tools typically engage the top edge of an underlying piece that is attached to the wall and support the bottom edge of an overlying piece while an individual fastens the overlying piece to the wall. These tools, however, fail to properly align pieces of fiber-cement siding because the pieces are not perfectly straight. More specifically, the width (i.e., the distance between the top and bottom edges) can vary across a fiber-cement siding piece. Thus, portions of the top edge of an underlying piece may be higher on the wall due to a greater width in those portions of the piece. These tools, therefore, may not properly align fiber-cement siding pieces because the position of the overlying piece is based on the position of the top edge of the underlying piece.

Another concern with fiber-cement and other types of siding is that some installers do not properly overlap the overlying and underlying siding pieces. For example, some installers attach siding pieces to the wall with insufficient overlap in order to reduce the number of pieces needed to cover the wall. When siding pieces are installed with insufficient overlap using the blind nail method, the nails in the pieces may be visible. If the installer corrects this problem by nailing the pieces closer to the top edge, the nails can ruin the top edge and the back surface of the pieces may not lay against the front surface of the underlying pieces. Consequently, the overlying piece may rattle in high winds or when windows or doors in the structure are closed. Moreover, wind lift may cause the overlying piece to fail. Additionally, when the nails are too close to the upper edge of an overlying piece of fiber-cement siding, the piece may appear to be warping or buckling even though fiber-cement pieces do not warp or buckle because they are inert. Furthermore, water can pass between insufficiently overlapped siding pieces and damage the wall. Such improperly installed siding can void the warranty and be costly to repair. Therefore, there is a significant need to assist installers in properly attaching siding pieces to structures.

DETAILED DESCRIPTION

A. Overview

Figure 1:
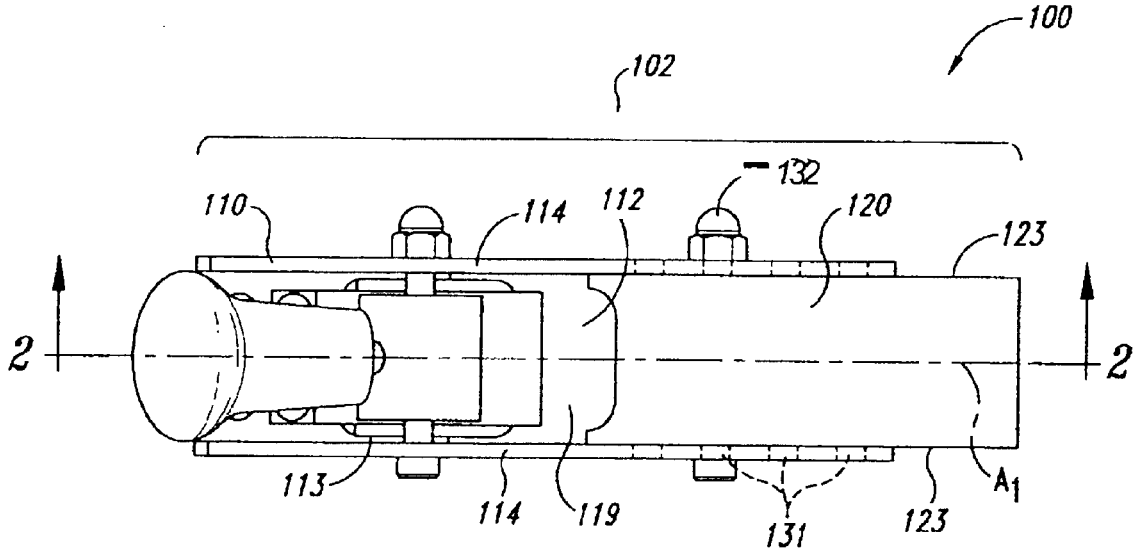
FIG. 1 is a schematic top plan view of an apparatus for installing siding materials on a wall of a structure in accordance with one embodiment of the invention.

The following disclosure describes several embodiments of siding installation apparatuses and methods for installing siding pieces on walls. The term "siding piece" is used throughout to include panels, planks, shakes, courses, and other siding materials. The term "fastener" is used throughout to include nails, screws, staples, adhesives, and any other fastening device or medium. Several embodiments of the invention are set forth in FIGS. 1-6 and the following text to provide a thorough understanding of particular embodiments of the invention. A person skilled in the art will understand, however, that the invention may have additional embodiments or that the invention may be practiced without several of the details described in the following description. For example, even though many specific details of the invention are described below with reference to fiber-cement siding and fiber-cement materials, the present invention can be practiced using other types of siding, such as metal, vinyl, wood/plastic composites, and other composites of natural and synthetic materials.

One aspect of the invention is directed to siding installation apparatuses for engaging a first siding piece and supporting a second siding piece. The first siding piece has a bottom portion and a back surface. In one embodiment, the apparatus includes a support member having a support surface to support the second siding piece, an engagement member projecting from the support member, and a securing assembly coupled to the support member to releasably restrict the support member from moving relative to the first siding piece. The engagement member is configured to engage the bottom portion of the first siding piece by contacting the back surface of the first siding piece. In one aspect of this embodiment, the support member includes a first portion and a second portion coupled to the first portion. The first portion has an adjustment axis and the second portion is selectively movable relative to the first portion along the adjustment axis. The support member can be configured to support the second siding piece so that a bottom surface of the second siding piece is spaced apart from a bottom surface of the first siding piece by a desired distance.

In another aspect of this embodiment, the securing assembly includes a cam pivotably coupled to the support member and a contact element proximate to the cam. The cam is selectively pivotable in a first direction to force the contact element against a front surface of the first siding piece to restrict movement of the support member relative to the first siding piece. The contact element can have a first surface with a first coefficient of friction and a second surface with a second coefficient of friction different than the first coefficient of friction. In other aspects of this embodiment, the securing assembly includes a contact element configured to contact the front surface of the first siding piece and a driving member configured to urge the contact element toward the first siding piece.

Another aspect of the invention is directed toward methods for installing siding pieces on a wall. In one embodiment, the method includes engaging a bottom portion of a first siding piece with an engagement member of a siding installation apparatus without engaging a top surface of the first siding piece and releasably restricting movement of a support member of the siding installation apparatus relative to the first siding piece. The first siding piece is attached to the wall, and the support member is attached to the engagement member. The method further includes supporting a portion of a second siding piece with the support member of the siding installation apparatus.

In another embodiment, the method includes positioning an engagement member of a siding installation apparatus between a back surface of a first siding piece and a wall and contacting a front surface of the first siding piece to selectively restrict movement of the support member relative to the first siding piece. The first siding piece is attached to the wall. The method further includes supporting a portion of a second siding piece with the support member so that a bottom surface of the second siding piece is spaced apart from a bottom surface of the first siding piece by a desired distance.

B. Siding Installation Apparatus

FIG. 1 is a schematic top plan view of an apparatus 100 for installing siding materials on a wall of a structure, such as an exterior wall of a house or other building. The apparatus 100 includes a support member 102 having a first portion 100 and a second portion 120 movably coupled to the first portion 110.

The first portion 100 includes a base plate 112 with an aperture 113 and two side walls 114 projecting from the base plate 112. In this embodiment, the base plate 112 and the side walls 114 form a channel 119. The first portion 110 also has a longitudinal axis $A_1$ extending generally parallel to the side walls 114. The side walls 114 can include a plurality of apertures 131 spaced sequentially along the longitudinal axis $A_1$.

Figure 2:
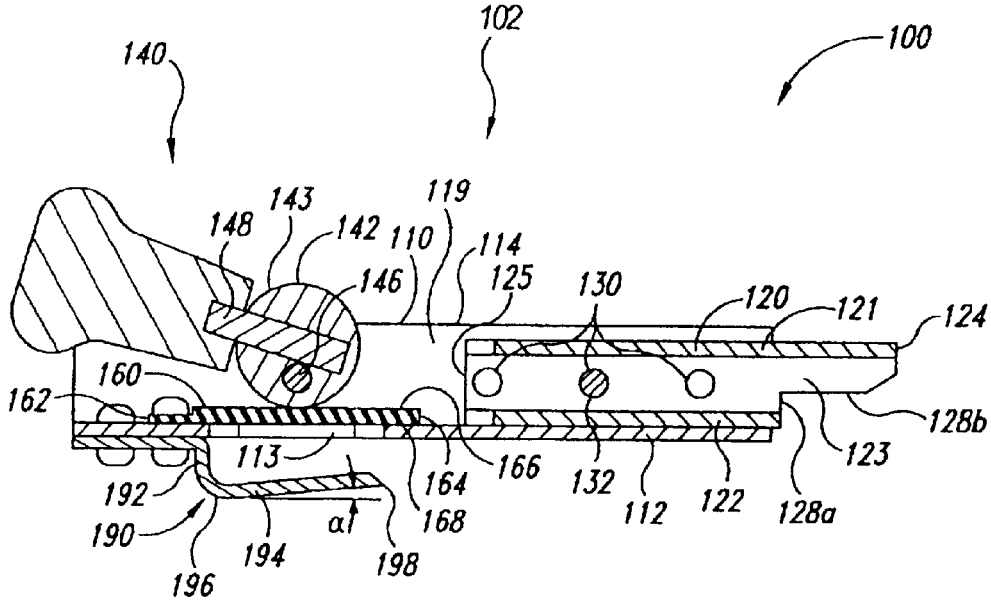
FIG. 2 is a schematic side cross-sectional view of the apparatus of FIG. 1 taken generally along the line 2-2.

FIG. 2 is a schematic side cross-sectional view of the apparatus 100 of FIG. 1 taken generally along the line 2-2. The second portion 120 of the support member 102 is received in the channel 119 of the first portion 110 and is selectively movable along the longitudinal axis $A_1$ (FIG. 1). The second portion 120 includes a first end 124, a second end 125 opposite the first end 124, a top wall 121, a bottom wall 122 opposite the top wall 121, and two side walls 123 coupled to the top and bottom walls 121 and 122. The first end 124 can include a first support surface **128*a* generally transverse to the top wall 121 and a second support surface 128*b* generally perpendicular to the first support surface 128*a*. The first and second support surfaces 128*a-b* are configured to jointly support a bottom portion of a siding piece, as described in greater detail below with reference to FIG. 3. Accordingly, the first and second portions 110 and 120 can be made of aluminum or another suitable material to support the siding piece. In the illustrated embodiment, the side walls 123 include a plurality of apertures 130 aligned sequentially along the longitudinal axis $A_1$ (FIG. 1) of the first portion 110**.

The embodiment of the apparatus 100 shown in FIGS. 1 and 2 further includes a fastener 132 received in an aperture 131 (FIG. 1) of the first portion 110 and an aperture 130 of the second portion 120 to restrict movement between the first and second portions 110 and 120 of the support member 102. The fastener 132 can be a bolt, pin, or other suitable device. The fastener 132 can be removed from the apparatus 100 to move the second portion 120 relative to the first portion 110 to provide a desired distance between the bottom surfaces of the overlying and underlying siding pieces, as described in greater detail below with reference to FIG. 3. In other embodiments, the first portion 110, the second portion 120, and/or the fastener 132 can have a different configuration. For example, the first portion 110 and second portion 120 can be universally adjustable with one of the portions having a slot to receive the fastener 132. Alternatively, the first and second portions 110 and 120 can have mating teeth.

The apparatus 100 of the illustrated embodiment further includes an engagement member 190 attached to the first portion 110 of the support member 102 to engage an underlying siding piece. The engagement member 190 includes a first portion 192 configured to be juxtaposed to a bottom surface of the underlying siding piece and a second portion 194 configured to contact a back surface of the underlying siding piece. The second portion 194 includes a first end 196 coupled to the first portion 192 and a second end 198 opposite the first end 196. The second end 198 of the second portion 194 can include a tip to allow the second end 198 to slide easily between siding pieces. The tip can have a sharp edge or a rounded edge to fit between the siding pieces. The engagement member 190 can be made of steel or another suitable material with the strength to engage the underlying siding pieces. The engagement member 190 also allows the apparatus 100 to hang from an installer's tool belt.

In one aspect of this embodiment, the second portion 194 is oriented at an angle $\alpha$ relative to the first portion 110 of the support member 102 so that the siding piece supported by the first support surface **128*a* does not fall between the apparatus 100 and the attached underlying siding piece. More specifically, the distance between the base plate 112 and the first end 196 can be greater than the distance between the base plate 112 and the second end 198. In other embodiments, the distance between the first end 196 and the base plate 112 can be less than or equal to the distance between the second end 198 and the base plate 112**.

The apparatus 100 further includes a securing assembly 140 to selectively restrict movement between the first portion 110 of the support member 102 and the engaged siding piece. In this embodiment, the securing assembly 140 includes a cam 142 pivotably coupled to the first portion 110, a lever 148 coupled to the cam 142, and a contact element 160. The cam 142 has a surface 143 and can be a cylindrical member attached by a fastener 146 to the first portion 110 in an eccentric arrangement. In other embodiments, the cam can have a non-cylindrical shape and be attached to the first portion 110 to provide a driving force generally normal to a plane defined by the base plate 112. The contact element 160 is positioned over the aperture 113 in the base plate 112 and includes a first end portion 162 attached to the base plate 112 and a second end portion 164 opposite the first end portion 162. The contact element 160 also includes a first surface 166 configured to contact the surface 143 of the cam 142 and a second surface 168 configured to contact the front surface of the engaged siding piece. At least the second surface 168 of the contact element 160 can be made of a compressible material. An advantage of the compressible material is that it allows the contact element 160 to compensate for variations in siding thickness and surface texture. Moreover, the compressible material will not mark or otherwise damage the siding when the contact element 160 engages the siding.

In one aspect of this embodiment, the first surface 166 of the contact element 160 has a first coefficient of friction and the second surface 168 has a second coefficient of friction greater than the first coefficient of friction. For example, the first surface 166 can be made of a nylon material and the second surface 168 can be made of a rubber material. Alternatively, the contact element 160 can be made of Teflon® coated rubber, Kevlar®, enclosed foam, and/or other suitable materials. Accordingly, the low friction first surface 166 allows the cam 142 to pivot easily while the high friction second surface 168 contacts a front surface of the engaged siding piece to prevent the piece from moving relative to the first portion 110, as described in greater detail below with reference to FIG. 3. In other embodiments, such as those described below with reference to FIG. 6, the securing assembly 140 can have a different configuration. For example, the contact element 160 can be attached to the cam 142 or the surfaces of the contact element 160 can have the same coefficient of friction.

Figure 3:
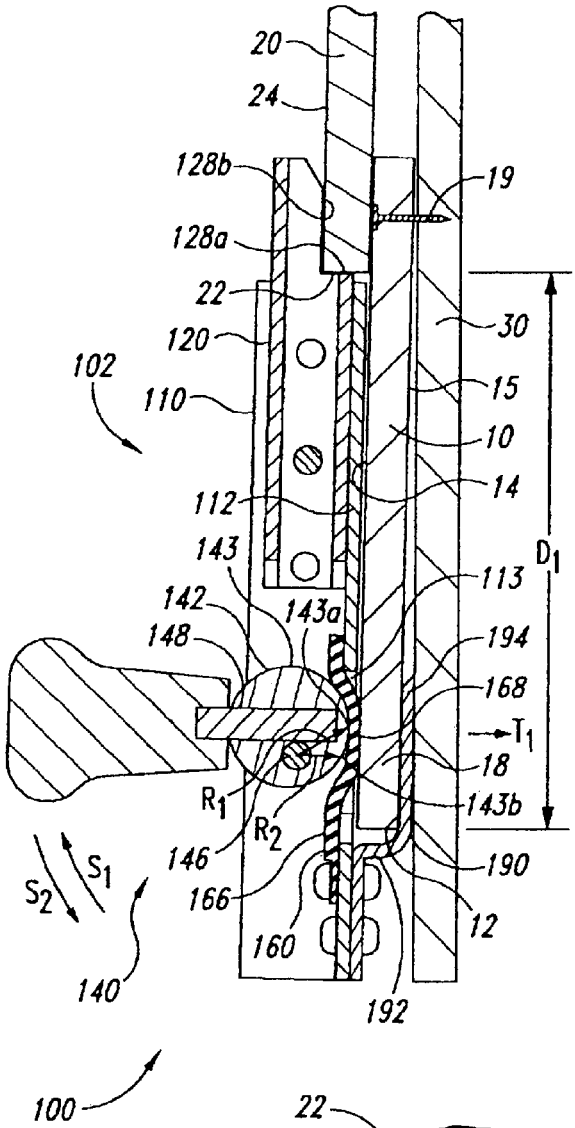
FIG. 3 is a schematic cross-sectional side view of the apparatus engaging a first siding piece and supporting a second siding piece.

FIG. 3 is a schematic cross-sectional side view of the apparatus 100 engaging a first siding piece 10 and supporting a second siding piece 20. The first siding piece 10 is attached to a wall 30 with a plurality of fasteners 19 (only one shown). To engage the first siding piece 10, the second portion 194 of the engagement member 190 slides behind the first siding piece 10. More specifically, the second portion 194 slides upwardly along the back surface 15 of the first siding piece 10 until the first portion 192 of the engagement member 190 contacts a bottom surface 12 of the first siding piece 10. Accordingly, a bottom portion 18 of the first siding piece 10 is received between the engagement member 190 and the base plate 112.

After the apparatus 100 is properly positioned on the first siding piece 10, the securing assembly 140 is actuated to restrict movement between the first portion 110 of the support member 102 and the first siding piece 10. More specifically, the cam 142 of the securing assembly 140 is rotated in a direction $S_1$ from a first position (illustrated in FIG. 2) to a second position (illustrated in FIG. 3). While moving from the first to the second position, the cam 142 contacts the first surface 166 of the contact element 160 and forces a portion of the contact element 160 through the aperture 113 of the base plate 112 in a direction $T_1$. Accordingly, the second surface 168 of the contact element 160 contacts and exerts a force against a front surface 14 of the first siding piece 10 to restrict movement between the apparatus 100 and the first siding piece 10. Thus, the securing assembly 140 can support the weight of the second siding piece 20.

In one feature of the illustrated embodiment, the contact element 160 moves in a direction generally normal to the first siding piece 10 to exert a force against the siding piece 10. An advantage of this feature is that it reduces or eliminates the scraping of the surface of the siding piece 10 that would occur if the contact element 160 moved along the surface. Moreover, it is easier to move the cam 142 from the first to the second position because the contact element 160 does not slide along the surface of the siding piece 10. Sliding the contact element 160 along the surface of the first siding piece 10 requires a force sufficient to overcome the friction between the contact element 160 and the siding piece 10.

In one embodiment, the cam 142 can remain in the second position until a force is exerted on the lever 148 to pivot the cam 142 back to the first position. The cam 142 can remain in the second position because a distance $R_1$ between the fastener 146 and a first location 143*a* on the surface 143 of the cam 142 can be less than a distance $R_2$ between the fastener 146 and a second location 143*b* on the surface 143 of the cam 142. Accordingly, in this embodiment a force is required to pivot the cam 142 in a direction $S_2$ from the second position to the first position to release the securing assembly 140 and remove the apparatus 100 from the first siding piece 10.

Figure 4:
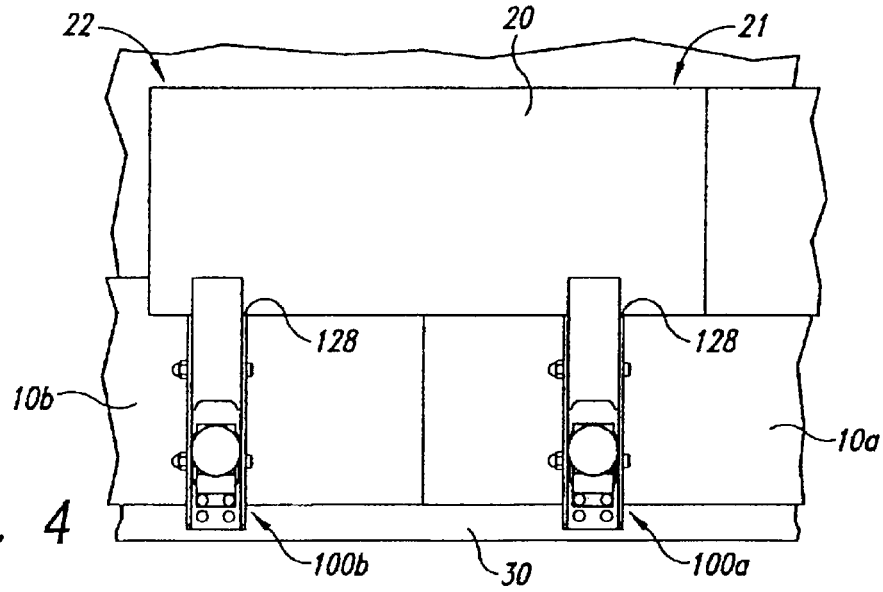
FIG. 4 is a schematic front view of the apparatus and the first and second siding pieces of FIG. 3.

FIG. 4 is a schematic front view of a first apparatus 100*a*, a second apparatus 100*b*, first siding pieces 10*a*-*b*, and the second siding piece 20. Referring to FIGS. 3 and 4, after the apparatuses 100*a*-*b* have securely engaged the first siding pieces 10*a*-*b*, a first end portion 21 (FIG. 4) of the second siding piece 20 can be placed on the first support surface 128*a* of the first apparatus 100*a* and a second end portion 22 (FIG. 4) of the second siding piece 20 can be placed on the first support surface 128*a* of the second apparatus 100*b*. Next, the installer attaches the second siding piece 20 to the wall 30 and then removes the apparatuses 100*a*-*b* from the first siding pieces 10*a*-*b*. In other embodiments, an installer may use just one apparatus 100. For example, the apparatus 100 can support the first end portion 21 of the second siding piece 20 while the installer supports and attaches the second end portion 22 to the wall 30.

Referring to FIG. 3, the piece 20 is placed on the apparatus 100 before attaching the piece 20 so that a bottom surface 22 of the piece 20 contacts the first support surface 128*a* and a front surface 24 of the second siding piece 20 contacts the second support surface 128*b*. The first and second portions 110 and 120 of the support member 102 are positioned to provide a desired distance $D_1$ between the bottom surface 12 of the first siding piece 10 and the bottom surface 22 of the second siding piece 20. The desired distance $D_1$ is selected so that the second siding piece 20 overlaps the first siding piece 10 the proper distance. For example, in one embodiment, pieces of siding having a width of 8¼ inches can have a desired distance of approximately 7 inches between the bottom surfaces. In other embodiments, the pieces can be spaced differently.

An advantage of the apparatus of the illustrated embodiment is that it allows a single installer to individually install siding pieces on a structure. A second installer is no longer needed to support the other end of the siding piece. The apparatus, therefore, decreases the labor costs of installing siding. Another advantage of the apparatus is that it is easier to use than many prior art devices that engage the top surface of an underlying siding piece. These prior art devices are difficult to remove after the overlying siding piece has been attached to the wall because the devices are sandwiched between the two siding pieces. Typically, the prior art devices must be slid sideways along the top surface to the end of overlying piece of siding to be removed. In contrast, the apparatus of the illustrated embodiment can be slid downwardly and is therefore much easier to remove. Another advantage of the illustrated embodiment is the configuration of the engagement member. The angled configuration of the engagement member forces the support member against the underlying siding piece to prevent the overlying siding piece from falling off the support surface.

Another advantage is that the illustrated apparatus properly aligns siding pieces because the bottom surface of each overlying piece is spaced apart a consistent distance from the bottom surface of each underlying piece. Thus, the pieces are properly aligned even when the pieces have nonuniform widths (i.e., when the distance between the upper surface and the bottom surface varies across a piece). Prior art devices that engage the top surface of the underlying siding piece may improperly align pieces of siding if the siding has a nonuniform width. For example, if an underlying piece of siding has a greater width at a first end than a second end, a prior art device that engages the top surface of the underlying piece will place the portion of the overlying piece proximate to the first end higher on the wall. That portion of the overlying piece is placed higher on the wall because the prior art device positions the overlying piece based on the top surface of the underlying piece. Thus, with prior art devices the overlying piece may not be horizontal or properly aligned if the underlying piece has a nonuniform width.

C. Other Siding Installation Apparatuses

Figure 5:
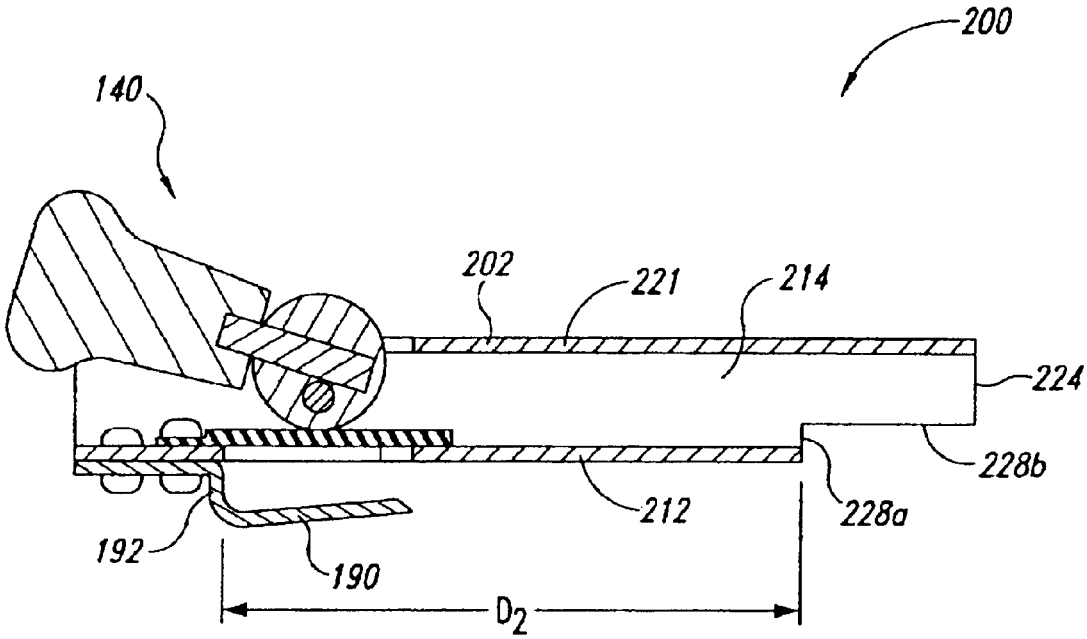
FIG. 5 is a schematic cross-sectional side view of an apparatus for installing siding pieces in accordance with another embodiment of the invention.

FIG. 5 is a schematic cross-sectional side view of an apparatus 200 for installing siding pieces in accordance with another embodiment of the invention. The apparatus 200 is generally similar to the apparatus 100 described above with reference to FIGS. 1-4. For example, the apparatus 200 includes a support member 202, a securing assembly 140 pivotably coupled to the support member 202, and an engagement member 190 attached to the support member 202. The support member 202 includes a base plate 212, a top wall 221 opposite the base plate 212, and side walls 214 coupled to the base plate 212 and the top wall 221. The support member 202 also includes a first end portion 224 having a first support surface 228*a* oriented generally perpendicular to the base plate 212 and a second support surface 228*b* oriented generally perpendicular to the first support surface 228*a*. The first support surface 228*a* and the first portion 192 of the engagement member 190 are spaced apart to provide a desired distance $D_2$ between the bottom surfaces of the siding pieces. The desired distance $D_2$ can be selected to provide the proper overlap between overlying and underlying siding pieces.

One feature of the apparatus 200 of the illustrated embodiment is that the desired distance $D_2$ between the bottom surfaces of the siding pieces cannot be changed. An advantage of this feature is that the desired distance is fixed, and accordingly, installers will be more likely to install siding pieces with the proper overlap. Properly overlapped pieces are less likely to rattle when in high winds or when windows or doors are closed, and they are less likely to have the appearance of warping and/or buckling. Moreover, the pieces are more likely to prevent water intrusion and the associated damage to the wall.

Figure 6:
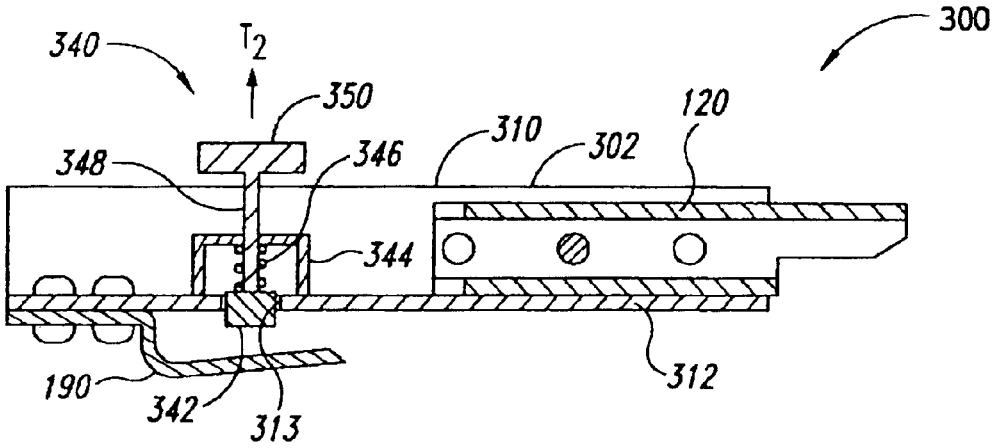
FIG. 6 is a schematic cross-sectional side view of an apparatus for installing siding pieces in accordance with another embodiment of the invention.

FIG. 6 is a schematic cross-sectional side view of an apparatus 300 for installing siding pieces in accordance with another embodiment of the invention. The apparatus 300 is generally similar to the apparatus 100 described above with reference to FIGS. 1-4. For example, the apparatus 300 includes an engagement member 190 and a support member 302 having a first portion 310 and a second portion 120 movably coupled to the first portion 310. The first portion 310 includes a base plate 312 having an aperture 313. The apparatus 300 further includes a securing assembly 340 to selectively restrict movement between the first portion 310 of the support member 302 and a siding piece. In the illustrated embodiment, the securing assembly 340 includes a contact element 342 configured to contact a front surface of the engaged siding piece, a support bracket 344 coupled to the first portion 310 of the support member 302, a driving member 346 positioned to urge the contact element 342 toward the engaged siding piece, an elongated member 348 coupled to the contact element 342, and a handle 350 coupled to the elongated member 348. The securing assembly 340 accordingly exerts a force against the front surface of the siding piece.

In operation, an installer can exert a force in a direction $T_2$ on the handle 350 to cause the contact element 342 to move away from the engagement member 190 so that a siding piece can be received between the base plate 312 and the engagement member 190. After the apparatus 300 engages the siding piece, the installer can release the handle 350 so that the driving member 346 forces the contact element 342 against the siding piece. In other embodiments, the apparatus can include a lock to selectively retain the driving member 346 and the contact element 342 in a retracted position so that the installer can engage the siding piece without holding the handle 350. In additional embodiments, the apparatus can include other securing assemblies. For example, the securing assembly can include a screw mechanism or other suitable device to exert a force on the siding piece.

From the foregoing, it will be appreciated that specific embodiments of the invention have been described herein for purposes of illustration, but that various modifications may be made without deviating from the spirit and scope of the invention. For example, the support member and engagement member are shown as two separate components, but these elements of the apparatus can be portions of an integral or unitary piece of material. Accordingly, the invention is not limited, except as by the appended claims.

We claim:

1. A method for installing fiber-cement siding pieces on a wall with a siding installation apparatus that includes a support member, an engagement member projecting from the support member, and a securing assembly coupled to the support member, the method comprising:

positioning a portion of the engagement member of the siding installation apparatus under a bottom surface of a first fiber-cement siding piece, the first fiber-cement siding piece being attached to the wall;

actuating the securing assembly and thereby restricting movement between the support member and the first fiber-cement siding piece by contacting a front surface of the first fiber-cement siding piece;

placing a bottom portion of a second fiber-cement siding piece on a support surface of the support member;

wherein the securing assembly includes a cam pivotably coupled to the support member and a contact element at least proximate to the cam; and wherein actuating the securing assembly comprises pivoting the cam to force the contact element through an aperture of the support member and against the front surface of the first fiber-cement siding piece.

2. The method of claim 1 wherein positioning the engagement member comprises positioning the support member proximate to the front surface of the first fiber-cement siding piece.

3. The method of claim 1 wherein positioning the engagement member comprises positioning a bottom portion of the first fiber-cement siding piece between the engagement member and the support member.

4. The method of claim 1 wherein positioning the engagement member comprises positioning at least a portion of the engagement member between the first fiber-cement siding piece and the wall.

5. The method of claim 1 wherein:

the support member includes a first portion and a second portion coupled to the first portion, the first portion having an adjustment axis and the second portion being selectively movable relative to the first portion along the adjustment axis; and the method further comprises moving the second portion of the support member relative to the first portion to adjust the spacing between the first fiber-cement siding piece and the second fiber-cement siding piece before positioning the engagement member.

6. The method of claim 1 wherein the contact element comprises a compressible material having a first end portion attached to the support member and a second end portion opposite the first end portion, and wherein the contact element is positioned over the aperture of the support member when the cam is in a first position before pivoting the cam and the contact element extends through the aperture when the cam is in a second position after pivoting the cam.

7. The method of claim 1 wherein the contact element has a first surface comprising a compressible material having a first coefficient of friction and a second surface having a second coefficient of friction less than the first coefficient of friction, and wherein pivoting the cam comprises sliding a surface of the cam along the second surface such that the first surface engages the second fiber-cement siding piece.

8. The method of claim 1 wherein the contact element is flexible and pivoting the cam comprises sliding a surface of the cam along a backside surface of the contact element such that a front side surface of the contact element moves through the aperture of the support member and contacts the second fiber-cement siding piece.

9. A method for installing siding pieces on a wall with a siding installation apparatus that includes a support member, an engagement member projecting from the support member, and a securing assembly coupled to the support member, the method comprising:

positioning the engagement member of the siding installation apparatus under a bottom surface of a first fiber-cement siding piece, the first fiber-cement siding piece being attached to the wail;

clamping a lower portion of the first fiber-cement siding piece and thereby restricting movement between the support member and the first siding piece by pressing a compressible material against a front surface of the first fiber-cement siding piece;

placing a bottom portion of a second fiber-cement siding piece on a support surface of the support member wherein the securing assembly includes a cam pivotably coupled to the support member and a contact element at least proximate to the cam; and wherein clamping the lower portion comprises pivoting the cam of the securing assembly to force the contact element through an aperture of the support member and against the front surface of the first fiber-cement siding piece.

10. The method of claim 9 wherein:

positioning the engagement member comprises positioning at least a portion of the engagement, member between the first fiber-cement siding piece and the wall; and clamping the lower portion comprises exerting a force against a front surface of the first fiber-cement siding piece.

11. The method of claim 9 wherein the contact element comprises a compressible material having a first end portion attached to the support member and a second end portion opposite the first end portion, and wherein the contact element is positioned over the aperture of the support member when the cam is in a first position before pivoting the cam and the contact element extends through the aperture when the cam is in a second position after pivoting the cam.

12. The method of claim 9 wherein the contact element has a first surface comprising a compressible material having a first coefficient of friction and a second surface having a second coefficient of friction less than the first coefficient of friction, and wherein pivoting the cam comprises sliding a surface of the cam along the second surface such that the first surface engages the second fiber-cement siding piece.

13. The method of claim 9 wherein the contact element is flexible and pivoting the cam comprises sliding a surface of the cam along a backside surface of the contact element such that a front side surface of the contact element moves through the aperture of the support member and contacts the second fiber-cement siding piece.

* * * * *

UNITED STATES PATENT AND TRADEMARK OFFICE

CERTIFICATE OF CORRECTION

PATENT NO. : 7,610,734 B2
APPLICATION NO. : 11/595617
DATED : November 3, 2009
INVENTOR(S) : Jonathan Edwards et al.

It is certified that error appears in the above-identified patent and that said Letters Patent is hereby corrected as shown below:

In column 1, line 7-13, delete "This application claims the benefit of U.S. Provisional Patent Application No. 60/474,685 entitled SIDING INSTALLATION APPARATUSES AND METHODS FOR INSTALLING SIDING PIECES ON WALLS filed on May 30, 2003, which is hereby incorporated by reference in its entirety." and insert -- This application is a divisional of U.S. Patent Application No. 10/607,643, filed June 26, 2003, which issues on November 14, 2006 as U.S. Patent No. 7,134,253, and claims the benefit of U.S. Provisional Patent Application No. 60/474,685 entitled SIDING INSTALLATION APPARATUSES AND METHODS FOR INSTALLING SIDING PIECES ON WALLS filed on May 30, 2003, both of which are hereby incorporated by reference in their entireties. --, therefor.

In column 3, line 58, delete "100" and insert -- 110 --, therefor.

In column 3, line 60-67, delete "The first..... axis $A_1$." and insert the same on col. 3, line 59, after "110." as a continuation of the same paragraph.

In column 3, line 60, delete "100" and insert -- 110 --, therefor.

In column 10, line 4, in claim 9, delete "wail;" and insert -- wall; --, therefor.

Signed and Sealed this

Thirtieth Day of March, 2010

David J. Kappos

David J. Kappos
*Director of the United States Patent and Trademark Office*